US005285975A

United States Patent [19]

Mayer et al.

[11] Patent Number: 5,285,975

[45] Date of Patent: Feb. 15, 1994

[54] PROCESS AND DEVICE TO SPOOL A YARN ON A SPINNING MACHINE/SPOOLING DEVICE

[75] Inventors: Walter Mayer; Johann Pohn; Gottefried Schneider, all of Ingolstadt, Fed. Rep. of Germany

[73] Assignee: Schubert & Salzer Maschinenfabrik AG, Ingolstadt, Fed. Rep. of Germany

[21] Appl. No.: 831,275

[22] Filed: Feb. 5, 1992

[30] Foreign Application Priority Data

Feb. 8, 1991 [DE] Fed. Rep. of Germany ..... 4103902

[51] Int. Cl.[5] ..... B65H 54/02; B65H 54/26; B65H 54/28; B65H 57/28

[52] U.S. Cl. ..... 242/18 R; 242/35.5 R; 242/43 R; 242/157 R; 57/263

[58] Field of Search ..... 242/18 R, 18 PW, 35.5 R, 242/35.5 A, 35.6 R, 43 R, 157 R, 158.3, 158.5; 57/263, 264, 299, 352, 353

[56] References Cited

U.S. PATENT DOCUMENTS

| | | | |
|---|---|---|---|
| 2,570,469 | 10/1951 | McDermott | 242/43 R X |
| 3,042,341 | 7/1962 | Hope | 242/157 R |
| 3,276,719 | 10/1966 | Stetz | 242/157 R |
| 3,587,989 | 6/1971 | Fisher et al. | 242/18 R |
| 3,640,059 | 2/1972 | Lutovsky et al. | 242/35.6 R X |
| 3,730,447 | 5/1973 | Franzen et al. | 242/18 PW |
| 4,041,684 | 8/1977 | Kamp . | |
| 4,084,759 | 4/1978 | Piro | 242/18 PW |
| 4,109,450 | 8/1978 | Yoshida et al. | 57/263 |
| 4,327,546 | 5/1982 | Derichs et al. . | |
| 4,466,575 | 8/1984 | Husges et al. | 242/18 PW |
| 4,501,116 | 2/1985 | Schuller et al. . | |
| 4,687,148 | 8/1987 | Schuller et al. | 242/18 PW |
| 4,716,718 | 1/1988 | Göbbels et al. | 57/263 |
| 4,891,933 | 1/1990 | Raasch | 57/263 X |
| 4,988,048 | 1/1991 | Lochbronner | 242/18 R |
| 5,022,222 | 6/1991 | Rupert et al. | 57/263 |

FOREIGN PATENT DOCUMENTS

| | | | |
|---|---|---|---|
| 1785153 | 12/1971 | Fed. Rep. of Germany . | |
| 3912254A1 | 10/1990 | Fed. Rep. of Germany . | |
| 512392 | 10/1971 | Switzerland | 242/157 R |
| 1526446 | 9/1978 | United Kingdom . | |

*Primary Examiner*—Stanley N. Gilreath
*Attorney, Agent, or Firm*—Dority & Manning

[57] ABSTRACT

A process and device is provided to handle the yarn after piecing or bobbin replacement where conical bobbins are used. According to the process and with the apparatus, the yarn is transferred to the yarn guide in such a manner that the yarn is first guided in direction of the smaller diameter of the bobbin or former before the winding of the yarn over the entire bobbin width of the bobbin takes place.

17 Claims, 4 Drawing Sheets

PROCESS AND DEVICE TO SPOOL A YARN ON A SPINNING MACHINE/SPOOLING DEVICE

BACKGROUND OF THE INVENTION

The instant invention relates to a process and device to spool a yarn on a conical bobbin or former subsequent to bobbin replacement or yarn breakage in an open-end spinning machine. DE OS 28 50 729 and DE 28 50 729 C2 disclose a method by which a yarn storage is incorporated into the course of the yarn by which the yarn reserve between the piecing device and the conical bobbin take-up is kept at least partially filled before the clamping roller is pressed against the draw-off roller, i.e. before the yarn is drawn off by the machine's pair of draw-off rollers during piecing in an open-end spinning device and subsequent winding of the spun yarn on a conical bobbin and to empty the yarn storage before yarn transfer to the spooling frame of the spinning machine. It is the purpose of DE 28 50 729 C2 to avoid thick spots and weak spots in the yarn during piecing as well as errors after the winding process with the utilization of conical bobbins.

DE OS 17 85 153 discloses a device used to spool conical cross-wound bobbins in which a yarn storage is provided to compensate for the irregularities in the course of the yarn which are caused by the utilization of conical bobbins. DE OS 25 41 589 discloses a device for automatic piecing in an open-end spinning machine.

In all known processes according to the present state of the art the yarn supplied by the spinning device is first handled by a service unit, whereby the yarn is withdrawn from the spinning device by a draw-off device of the service unit and is conveyed to the bobbin of the spinning machine by various levers and graspers of the bobbin. The bobbin can also be driven by a drive of the service unit. While the yarn is handled by the service unit, and also at the moment when the yarn is already being conveyed from the spinning device to the bobbin, no back-and-forth winding of the yarn on the bobbin takes place. Only when the yarn has been securely applied to the cross-would bobbin is it transferred to the yarn guide of the spooling station for cross-wound spooling on the bobbin of the service unit, making it possible for the normal spooling of a cross-wound bobbin to begin or to be continued. At the yarn is transferred from the service unit to the cross-winding device, a transfer to the draw-off device of the spinning machine is generally carried out at the same time. The process for piecing and subsequent transfer of the yarn to the spooling station of the spinning machine are well known according to the present state of the art.

In addition to cylindrical bobbins, an ever increasing number of cross-wound bobbins is being spooled by the spooling devices of open-end spinning machines. The transfer of the yarn by the service unit to the spooling device, by hand when manual piecing is carried out, produces brief tension peaks in the yarn at the moment when the cross-winding device grasps the yarn. This is especially troublesome when conical bobbins are spooled. Excessive yarn tension then occurs and risks causing yarn breakage. If the yarn is conveyed in the direction of the larger diameter of the conical bobbin when it has been grasped by the yarn guide, the effects of different circumferential speeds in conical cross-wound bobbins is added to the stress on the yarn produced as it is being grasped by the yarn guide. If the yarn is immediately conveyed in the direction of the larger diameter of the former or bobbin when it has been grasped by yarn guide, yarn breakage occurs more frequently.

OBJECTS AND SUMMARY OF THE INVENTION

It is a principal object of this invention to create a process and a device by means of which the above-described problems in spooling conical bobbins in open-end spinning machines can be avoided. Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The object of the is attained by the process and device of the present invention. According to the process of the invention, if the yarn thrown off by the service unit into the path of the yarn guide is grasped by the latter only when it is moving in direction of the smaller diameter of the bobbin, the effective diameter of said bobbin is always smaller at a constant rotational bobbin speed, causing the tension produced in the yarn during spooling to drop, so that no danger of yarn breakage exists. This method eliminates the earlier, random distribution in which the yarn was grasped one time as it moves toward the larger diameter and another time as it moves toward the smaller diameter. The process described herein thus ensures at all times that the yarn is not subjected to increased stresses when it is transferred to the yarn guide of the spooling device, even when conical bobbins are wound.

In an advantageous further embodiment of the process of the present invention, the position of the yarn guide and/or of its direction of movement is detected, so that a point in time may determined at which the transfer of the yarn to the cross-winding device of the spinning machine always causes the yarn to be grasped by the yarn guide as the guide is moving towards the smaller diameter of the bobbin. Here it is especially advantageous for the direction and/or position of the yarn guide to be monitored by the service unit of the spinning machine.

A further advantageous embodiment of the process provides for the cross-winding device to be the kind of yarn guide which is able to catch the yarn when it crosses the yarn's path moving towards the smaller diameter of the bobbin and, at the same time, does not catch the yarn if it crosses the yarn path moving towards the larger diameter of the bobbin. In the latter case it is especially advantageous for the yarn guide to pass underneath the yarn, and in so doing to move it across and over its yarn receiving opening.

The design of the yarn guide according to the invention makes it possible to carry out the process according to the invention in a particularly simple and inexpensive, as well as in a particularly reliable and trouble-free, manner.

It is especially advantageous to provide a lateral delimitation of the yarn guide, designed so that it catches the yarn during a movement towards the smaller diameter of the bobbin and so that it lifts the yarn across the opening of the yarn guide during a movement in the opposite direction, causing the yarn guide to slide under the yarn without grasping or damaging or stressing it.

By designing the opening for the acceptance of the yarn in form of a slit constituted by a space between the two delimitations, the yarn guide is especially easy to produce, especially if it is made of a ceramic material.

The process according to the invention is preferably carried out by using a device which detects the position of the yarn guide, or the direction of travel of the yarn guide, and thereby controls the point in time when the yarn is transferred from the service unit to the spooling device. It is especially advantageous for a sensor which monitors the position of the yarn guide to be installed in the service unit which handles the yarn for bobbin replacement or to repair yarn breakage and then transfers it to the spooling device of the spinning station, and which can be brought to the spooling station concerned to detect the position of the yarn guide of said spooling device.

In another advantageous embodiment of the invention, the sensor is located at any desired location of the spinning machine which is suitable to monitor the position or the direction of movement of the yarn guide. In this embodiment, the information is transmitted from the sensor location via a transmission circuit to a control device which controls the transfer of the yarn to the spooling device of the spinning machine. Through appropriate design of the controls, the yarn guide is moved first in the direction of the smaller diameter of the conical bobbin. The controls of the service unit are here adjusted so that the time delay produced because the yarn has covered the distance between the transfer device and the area in which it is grasped by the yarn guide is compensated for. By utilizing an optic or capacitive or contact sensor, reliable acquisition of the information is ensured.

BRIEF DESCRIPTION OF THE DRAWINGS

The invention is described below through drawings.

DESCRIPTION OF THE PREFERRED EMBODIMENTS

Figure 1:
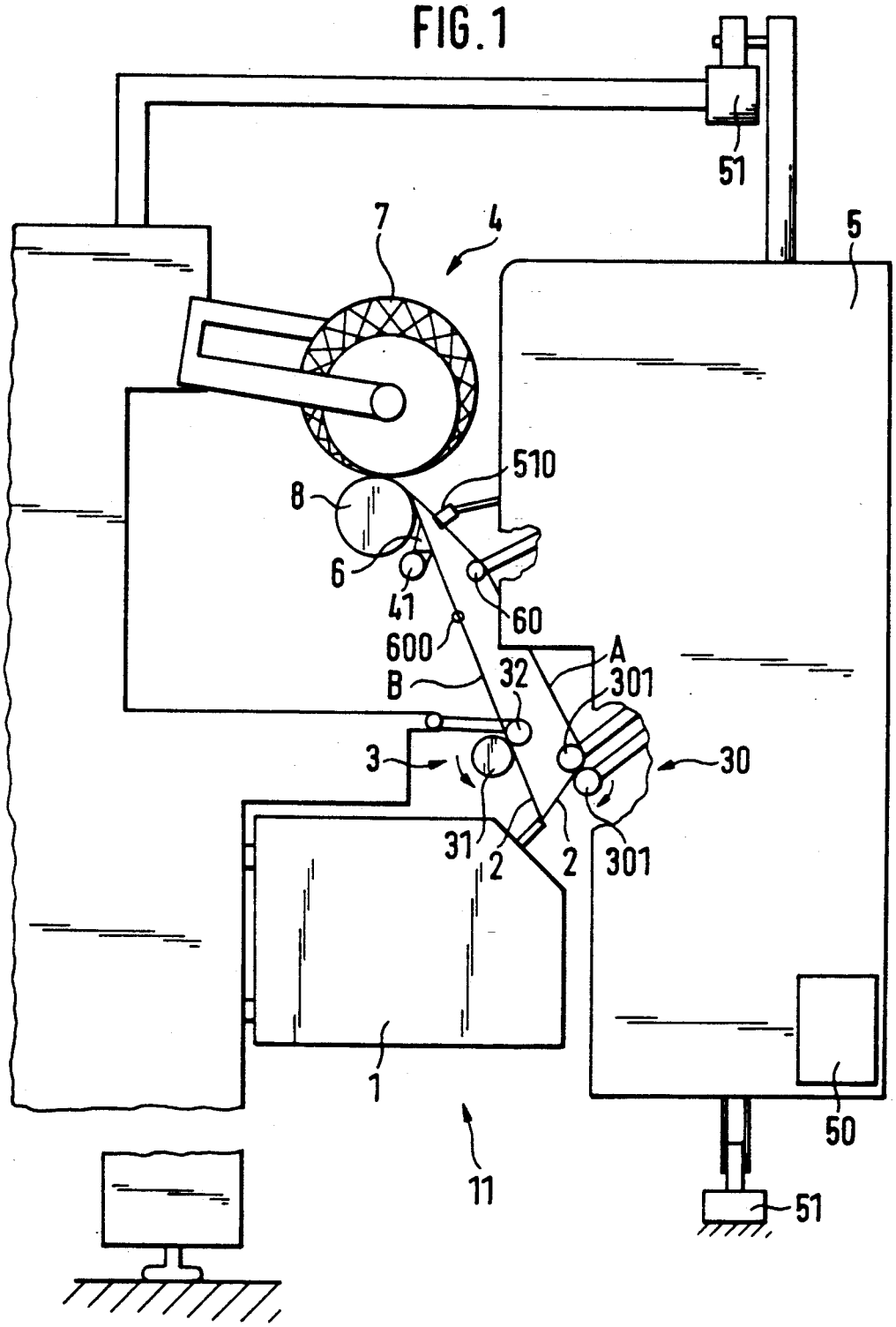
FIG. 1 shows a sectional perspective view of an open-end spinning device with a service unit assigned to this spinning device.

Reference will now be made in detail to the presently preferred embodiments of the invention, one or more examples of which are illustrated in the accompanying drawings. The numbers of components in the drawings is consistent, with the same components having the same number in each of the drawings and being interchangeable between the embodiments of the figures.

The open-end spinning device 11 of FIG. 1 is equipped with a spinning device 1 in which a yarn 2 is being formed and is withdrawn by a pair of draw-off rollers 3 consisting of a fixed rotating draw-off roller 31 and a pressure roller 32 which can be moved towards roller 31 pressing the yarn on the draw-off roller 31. Spinning device 11 includes a spooling station 4 where the formed yarn is wound on a conical cross-wound bobbin. In front of the spinning station, a travelling service unit 5 has been brought into position. The service unit 5 travels on rails 51 along the spinning stations of the spinning machine and is, as a rule, brought automatically to the spinning station during the yarn production in order to correct malfunctions, in order to carry out bobbin replacement at that location, or to repair yarn breakage. FIG. 1 shows the course B of the yarn in normal spinning operation and, at the same time, the course A of the yarn such as it presents itself for example in case of yarn breakage repair, shortly before the transfer of the yarn from the service unit to the spooling station of the spinning machine. When the normal course B of the yarn is followed, the yarn produced by the spinning station 1 is withdrawn by the pair of draw-off rollers 3 from the spinning station 1 and is conveyed via yarn guide 6 to the bobbin 7 which winds it up by rotating. The bobbin 7 is driven by the friction roller 8. In this case the yarn guide 6 is moved in a back-and-forth movement along the bobbin by the cross-winding rod on which it is mounted. A cross-wound bobbin is thereby produced.

The course A of the yarn applies when the yarn 2 is handled by the service unit 5 for the repair of a yarn breakage or, for example, also in case of bobbin replacement. In this case the yarn 2 is withdrawn from the spinning station by means of an auxiliary pair of draw-off rollers 30. The auxiliary pair of draw-off rollers 30 is equipped with two auxiliary draw-off rollers 301 for that purpose. From these auxiliary draw-off rollers 301 the yarn runs over an auxiliary yarn guide 60 and from there to the bobbin 7. In this case the bobbin can also be driven by a driven friction roller which is lowered by the service unit to the bobbin, as is well known in the art. While the yarn 2 is handled by the service unit 5 it is taken out of the yarn guide 6 and therefore is not cross-wound on the bobbin during transfer. Since this is the case only for a brief period, the quality of the bobbin structure is not affected significantly. It is however desirable for normal bobbin build-up to be resumed as quickly as possible following the elimination of the malfunction. For this purpose the yarn 2 is transferred from the service unit 5 to the spooling station 4. At the same time the auxiliary draw-off rollers 30 are opened and the auxiliary yarn guide 60 is moved in an appropriate manner so that the yarn leaves the auxiliary yarn guide 60 and the auxiliary pair of draw-off rollers 30 to be received by the pair of draw-off rollers 3 and the yarn guide 6 of the spooling station 4. For this purpose it is brought into nip range between draw-off roller 31 and pressure roller 32, is grasped by the yarn guide 6, and is moved back and forth alongside the bobbin by motion of yarn guide 6 along cross-winding rod 41.

In another known procedure for the handling of the yarn by the service unit, the yarn runs out of the spinning station via an auxiliary yarn guide directly to the bobbin and is then withdrawn by same from the spinning station. Following the transfer of the yarn by the auxiliary yarn guide to the yarn guide 6, the yarn 2 is pulled automatically into the gap between draw-off roller 31 and pressure roller 32 so that from that moment on it is withdrawn from the spinning station by the pair of draw-off rollers 3. All of the different procedures for the handling of the yarn have in common that the yarn is taken out of the yarn guide 6 and must again be returned to same to start normal spooling. The present invention can be used for all of these known processes and devices.

Figure 2:
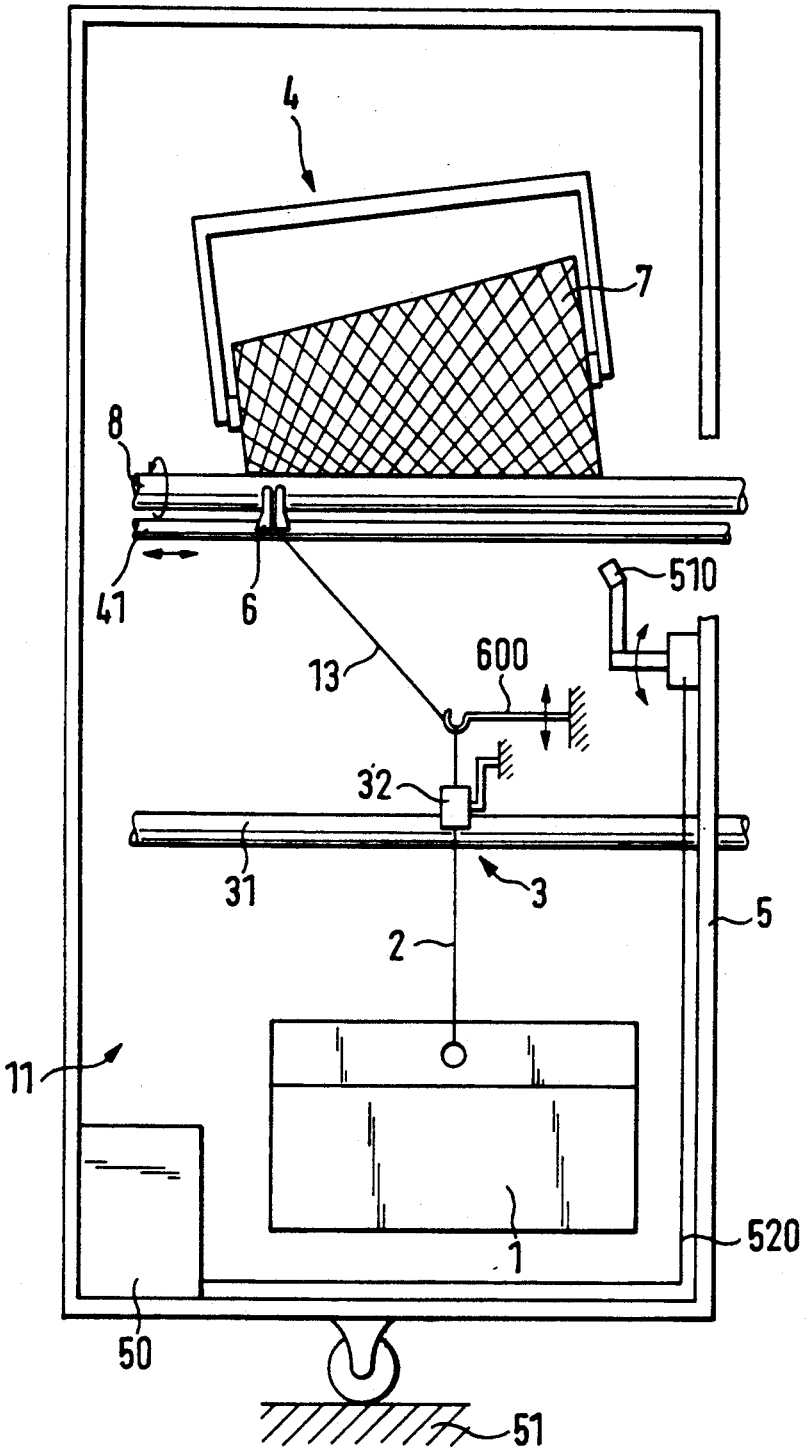
FIG. 2 shows a frontal perspective view of the spooling device with elements of a service unit assigned to same.

FIG. 2 shows an open-end spinning device 11 with a spinning device 1 in which a yarn 2 is being produced. The shown course B of the yarn corresponds to FIG. 1 and shows the normal course of the yarn in filling a cross-wound bobbin 7. The yarn 2 is withdrawn from the spinning device 1 by means of the draw-off roller 31 and the pressure roller 32. The yarn runs from the pair of draw-off rollers 3 over a yarn compensating hoop 600 to the yarn guide 6 of the spooling station 4. The yarn compensating hoop 600 serves to take up excess yarn lengths which develops from time to time during cross-winding and especially when conical bobbins are wound. The yarn guide 6 is attached on the cross-winding rod 41 and is guided back and forth alongside the bobbin 7. In this process, the yarn guide 6 deposits the yarn 2 between bobbin and friction roller 8, causing the yarn to be wound up on the bobbin. Only the outlines of the service unit 5 in front of the spinning station as well as of the sensor 510 which can be brought to the spinning station and of the control unit 50 are drawn in. The circuit 520 connects sensor 510 and control unit 50.

Figure 3:
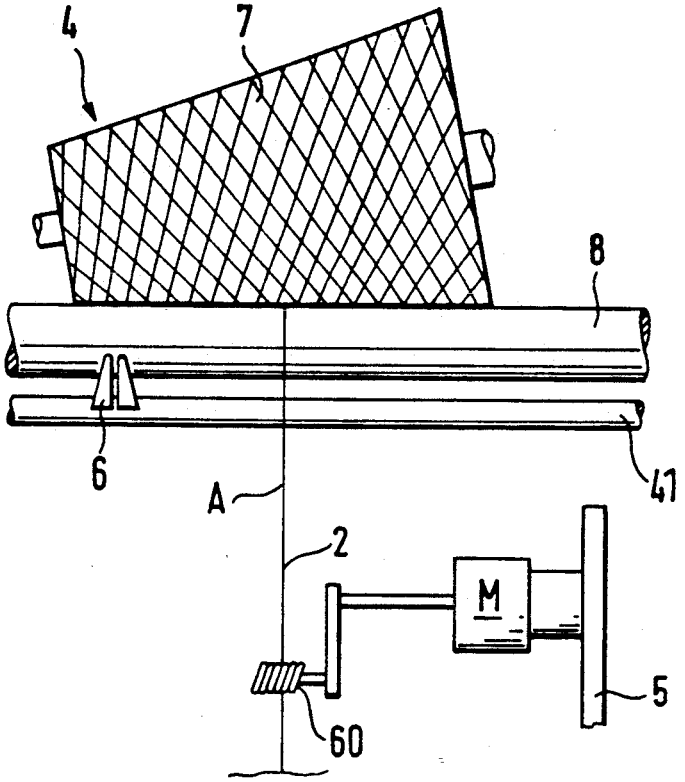
FIG. 3 shows a partial perspective view of a spooling station with the yarn being guided by the service unit.

FIG. 3, similarly to FIG. 2, shows the elements of a spooling station 4 with a bobbin 7, a friction roller 8, the cross-winding rod 41 and the yarn guide 6. In FIG. 3 the yarn 2 takes course A as discussed according to FIG. 1. As in FIG. 1, the yarn runs out of the spinning station 1, either via a pair of draw-off rollers 3 or a pair of auxiliary draw-off rollers 30 or also directly to an auxiliary yarn guide 60 (schematically indicated) which is part of a service unit 5. The auxiliary yarn guide 60 is designed in the form of a threaded spindle so that for the process of yarn transfer, the yarn can be brought to the very end of the auxiliary yarn guide 60 through the rotation thereof. As a result, the yarn leaves the auxiliary yarn guide 60 and comes within range of the yarn guide 6. The course of the yarn after the transfer by the auxiliary yarn guide 60 can be seen in FIG. 1. The yarn runs over a yarn compensating hoop 600 to the friction roller 8. The yarn comes to lie in a plane in which the yarn guide 6 moves back and forth in front of the bobbin 7. As a result the yarn 2 is caught in a known manner by the yarn guide 6 and is taken along in its cross-winding movement.

If the transfer of the yarn is based on the process according to this application, the result obtained is that the yarn is first guided towards the smaller diameter of the conical bobbin at the beginning of normal bobbin spooling, before being cross-wound along the entire width of said bobbin. This can be achieved by continuing to use a previously known yarn guide which catches the yarn regardless of whether it encounters the yarn during a movement to the left alongside the spooling station, or during a movement to the right. When such a conventional yarn guide is used, the invention requires only that care be taken to ensure that the yarn guide comes into contact with the yarn in such manner that the yarn guide catches the yarn during movement towards the smaller diameter of the conical bobbin. In order to achieve this, the position of the yarn guide at the spinning machine or at an individual spinning station is recorded, this information is transmitted to the controls of the service unit and the latter controls the auxiliary yarn guide 60 which transfers the yarn to the yarn guide 6 at the appropriate time.

FIG. 1 shows the service unit 5 with its control unit 50 which can also be installed outside the service unit, for example, on the spinning machine itself. The service unit 5 is equipped with a sensor 510 which is able to ascertain the position of the yarn guide 6. The sensor 510 is presented by the service unit 5 to the spooling station 4 before transfer of the yarn. The sensor 510 recognizes the position of the yarn guide 6 at the time the yarn guide reverses its direction of travel at the bobbin end with the larger diameter. The signal emitted at that moment by the sensor 510 is transmitted via a circuit 520 to the control unit 50 and is translated by control unit 50 into a control command signal to the auxiliary yarn guide 60, so that the latter throws off the yarn through an appropriately suitable movement and transfers it to the spooling station of the spinning station 1. In this manner, before the return of the yarn guide 6 from the larger diameter bobbin end to the yarn-receiving point, the yarn is already waiting at that location to be grasped by the yarn guide and to be moved in direction of the smaller diameter end of the bobbin.

However the control unit can also function if the sensor is positioned by the service unit on the other side (length) of the bobbin. In this manner, the position of the yarn guide is ascertained when said yarn guide is located in the area of the smaller diameter of the bobbin. This procedure is advantageously followed when the auxiliary yarn guide takes a relatively longer time to transfer the yarn after having received the signal for yarn transfer. Then, when the signal is transmitted, i.e. when the yarn guide is located at the smaller diameter of the bobbin, the required time is available for the yarn guide to travel along the entire bobbin and to change direction for return travel at the larger diameter before the yarn is transferred from the auxiliary yarn guide. It would also be possible to ascertain the position of the yarn guide at any desired location and to control the transfer of the yarn with a corresponding appropriate time delay.

Just as the sensor can be brought by the service unit to a spooling station, it is also possible to install the sensor permanently on the spinning machine and to detect from this permanent location the position of the yarn guide, of a specific point on the cross-winding rod, or even a specific position of known conventional gearing or drive mechanism which drives the cross-winding rod. In that case a transmission circuit for the sensor is provided which connects the sensor to the control unit for yarn transfer. With a permanent installation of the sensor on the spinning machine no additional space is required in the service unit for the sensor. Additionally, since circuits for data transmission are in any case provided between the spinning machine and service unit in open-end spinning machines, no special measure or means is required for transmission of the signal from the sensor, and permanent installation of a sensor on the spinning machine is especially advantageous. By installing the sensor in the known gearing of the cross-winding rod it is even possible to ascertain the position of the yarn guides of each spinning station in the spinning machine with one single sensor, even if two cross-winding rods are used in the spinning machine. Since these conventional cross-winding rods function at the same frequency, yarn transfer can be controlled reliably according to the invention by means of a signal of a sensor together with indicating which side of the spinning machine is being serviced by the service unit.

Figure 4:
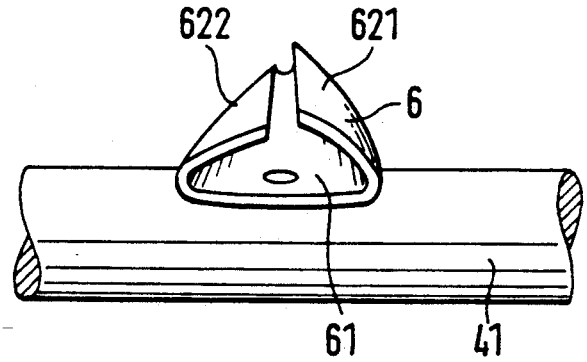
FIG. 4 is a perspective view of a yarn guide designed according to the invention and mounted on its cross-winding rod.
Figure 7:
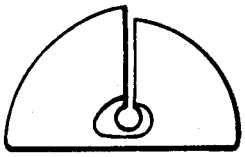

The process according to the invention can also be carried out without the use of a sensor controlling the yarn transfer. FIG. 4 shows a yarn guide 6 according to the invention mounted on a cross-winding rod 41. The yarn guide 6 consists of a basic ceramic body which is provided with a guide 61 for the yarn, said guide being delimited by two lateral delimitations 621, 622. The yarn is held by these in the guide 61 during the back-and-forth movement of the guide. FIG. 4 shows the yarn guide from the perspective of the yarn entering the yarn guide. FIG. 7 shows a view of the yarn guide as seen from the side of yarn output.

Figure 5:
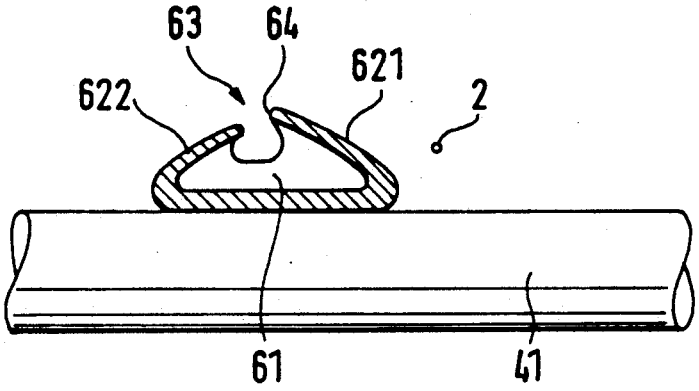
FIG. 5 is a cross-sectional view through the yarn guide of FIG. 4.

FIG. 5 shows a section through the yarn guide of FIG. 4. The yarn guide shown here is suitable for a spooling device in which the side of the bobbin with the larger diameter is on the right side as seen from the aspect of FIG. 5. FIG. 5 shows a yarn 2 which has just been transferred to the spooling device. After the transfer, this yarn lies in a plane in which it comes into contact with the yarn guide as the latter travels. When the yarn guide of FIG. 5 moves to the right, it lifts up the yarn with its right delimitation 621 and travels below the yarn. The opening 63 of the guide is so narrow that the yarn which is lifted up by the right delimitation 621 is already lifted over and across the opening 63 as the yarn guide moves to the right, before dropping back to its original plane. Depending on spring tension, the yarn then comes into contact at most with the left delimitation 622, but is not received by the opening 63 or laid on the guide 61. In the return movement (in FIG. 5 from right to left) of the yarn guide during which the yarn first comes into contact with the left delimitation 622, the yarn 2 is also lifted up, but not over and past the opening 63, so that the yarn is seized by the catching edge 64 of the right delimitation 621 and is transferred into guide 61. This design of the yarn guide makes it possible for the yarn to be caught by the yarn guide during the movement of said yarn guide towards the bobbin end with the smaller diameter. The yarn guide shown in FIGS. 4, 5 and 7 is designed so that the opening 63 is not covered by the lateral delimitations. Secure and correct catching of the yarn is achieved in that the appropriate, in this case the right-side delimitation 621 of the guide of the yarn guide 6, extends above the left-side delimitation 622. As a result it is possible to achieve a direction of travel that is such that the yarn 2 is lifted by the right delimitation 621 over and across the opening while at the same time, when travel is in the opposite direction, the yarn is able to get under the catching edge 64 of the right delimitation 621, so that it is deposited on the yarn guide 61 in the yarn guide 6.

Figure 6:
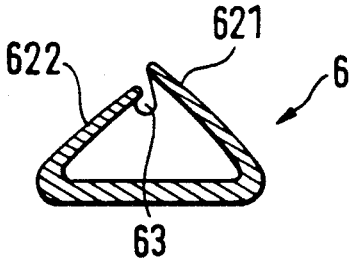
FIGS. 6 to 8: are different perspective views of embodiments of yarn guides according to the invention.
Figure 8:
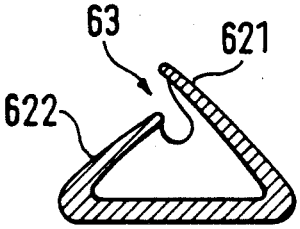

FIG. 6 shows a sectional view a yarn guide 6 according to the invention in which the right delimitation 621 together with the left delimitation 622 barely cover the opening 63. As illustrated in the Figure, the edge of right delimitation 621 extends above and to the edge of left delimitation 622. As a result there is no danger, even at a very slow travel speed of the yarn guide, that the yarn may enter the opening 63 after reaching the end of the right delimitation 621. An especially advantageous embodiment with this characteristic is shown in FIG. 8, where the edge of the right delimitation 621 overlapping the edge of left delimitation 622. At the same time, the left delimitation 622 is designed with its steep outer side in such manner that a yarn falling down on it from the right delimitation 621 is directed away from the opening 63. The overlap can be much more pronounced than is illustrated in the embodiment shown in FIG. 8.

It will be apparent to those skilled in the art that various modifications and variations can be made in the apparatus and method of the present invention without departing from the scope or spirit of the invention. Thus, it is intended that the present invention cover the modifications and variations of the is invention provided they come with the scope of the appended claims and their equivalents.

We claim:

1. A process for use in a textile machine of the type in which yarn is wound on a conical bobbin through a yarn guide which is guided in a back and fourth path across the bobbin, said process for reducing yarn tension and occurrence of yarn breakage during resumption of the yarn winding following an interruption wherein a yarn must be delivered to the yarn guide for back and fourth winding on the bobbin, said process comprising the steps of:

retaining the yarn at a position on a travelling service unit remote from the yarn guide so that the yarn is initially wound onto the bobbin without contacting the yarn guide as it traverses the back and forth path across the bobbin;

delivering the yarn from the remote position on the travelling service unit to a position across the back and forth path of the yarn guide;

grasping the delivered yarn with the yarn guide; and controlling said grasping of the delivered yarn by the yarn guide only when the movement of the yarn guide is in the direction from the larger to the smaller end of the bobbin so that the initial winding of the yarn on the bobbin by the yarn guide is always as the yarn guide is moving towards the smaller diameter end of the bobbin.

2. The process as in claim 1, wherein said controlling step comprises ascertaining the relative position of the yarn guide with respect to the bobbin and generating a transfer control signal responsive thereto when the guide is at such a position so that the yarn can be transferred to the yarn guide path to only be grasped by the yarn guide as it travels from the larger diameter end of the bobbin to the smaller diameter end of the bobbin.

3. The process as in claim 2, further comprising generating the transfer control signal at substantially the time the guide transitions from its travel towards the larger diameter bobbin end to the smaller diameter bobbin end.

4. A textile device having at least one spinning unit for producing yarn, a yarn draw-off unit for withdrawing the yarn from the spinning unit, a bobbin holder for supporting a conical bobbin, a drive mechanism driving the bobbin, a drive mechanism for operatively guiding a yarn guide for back and forth motion in a travelling path alongside the bobbin to distribute yarn over the bobbin, said device further comprising:

a yarn guide having generally oppositely facing lateral delimitations and a guide section defined generally between said lateral delimitations, said delimitations defining an opening into said guide section for the yarn, said delimitations configured so that said yarn guide only grasps and guides the yarn through said opening into said guide section if said yarn guide is travelling in the direction from the larger diameter bobbin end to the smaller diameter bobbin end;

means for retaining the yarn at a position remote from the travelling path of said yarn guide; and a yarn transfer device separate from said yarn guide for transferring the yarn from said remote position of a predetermined time to a position across the travelling path of said yarn guide;

whereby upon transferral of the yarn to the travelling path of said yarn guide following an interruption of yarn winding on the conical bobbin, the yarn is only initially grasped and wound on the bobbin as the yarn guide travels in the direction of the larger diameter bobbin end to the smaller diameter bobbin end.

5. The device as in claim 4, wherein said lateral delimitation of said yarn guide towards the larger diameter bobbin extends above said lateral delimitation towards the smaller diameter bobbin end.

6. The device as in claim 5, wherein said lateral delimitations comprise edges, said edge of said lateral delimitation towards the larger diameter bobbin end extending to substantially the vertical plane of said edge of said lateral delimitation towards the smaller diameter bobbin end.

7. The device as in claim 5, wherein said lateral delimitations comprise edges, said edge of said lateral delimitation towards the larger diameter bobbin end extending past the vertical plane of said edge of said lateral delimitation towards the smaller diameter bobbin end.

8. A textile spinning machine for producing yarn, said machine comprising:

a spinning unit having a spinning device for producing yarn;

a yarn draw-off device for withdrawing yarn from the spinning unit;

a bobbin holder for supporting a conical bobbin, and a drive mechanism for driving the conical bobbin for winding yarn thereon;

a yarn winding device for winding yarn onto the conical bobbin, said yarn winding device including a yarn guide disposed for back and forth motion in a travelling path across the conical bobbin;

a yarn retaining device, said retaining device configured to retain the yarn at a remote position so as not to be contacted by said yarn guide during any portion of its travel while the yarn is initially wound on the conical bobbin;

a yarn transfer device separate from said yarn guide for transferring the yarn from said remote position to the travelling path of said yarn guide following an interruption of normal yarn winding for resumption of yarn winding onto the conical bobbin by said yarn guide; and means for controlling the transfer of yarn to said yarn guide for resumption of normal yarn winding in such a manner so that the yarn is initially wound onto the conical bobbin by said yarn guide in the direction of the larger to smaller diameter bobbin end.

9. The machine as in claim 8, wherein said textile machine comprises a plurality of said spinning units and said yarn transfer device and said controlling means are carried by a travelling service unit configured to travel alongside said spinning units.

10. The machine as in claim 8, wherein said controlling means comprises a sensor operably disposed for determining the direction of travel of said yarn guide with respect to said conical bobbin and generating a signal corresponding thereto, and a control device receiving said signal and controlling said yarn transfer device in response thereto so that the yarn is transferred to the path of said yarn guide at such a time so that said yarn guide will only grasp the yarn as it travels towards the smaller diameter end of the bobbin.

11. The machine as in claim 10, wherein said textile machine comprises a plurality of said spinning units and said sensor and said control device are carried by a travelling service unit configured to travel alongside said spinning units.

12. The machine as in claim 10, wherein said textile machine comprises a plurality of said spinning units with all of said yarn guides being driven by a common drive, said sensor operably disposed relative to at least one component of said common drive to simultaneously determine the position of all said yarn guides.

13. The machine as in claim 8, wherein said controlling means comprises oppositely facing lateral delimitations defined on said yarn guide, said delimitations configured relative each other so that said yarn guide only grasps and holds the yarn if said yarn guide is travelling in only one predetermined direction.

14. The machine as in claim 13, wherein one said lateral delimitation extends above said other lateral delimitation so that the taller lateral delimitation will grasp and guide yarn into said yarn guide as said yarn guide travels below the yarn in a direction of travel such that the shorter lateral delimitation is leading.

15. The yarn guide as in claim 14, wherein the shorter lateral delimitation faces the smaller diameter bobbin end.

16. The yarn guide as in claim 14, wherein said lateral delimitations comprise edges, the taller lateral delimitation edge extending past the vertical plane of the shorter lateral delimitation edge.

17. The yarn guide as in claim 14, wherein said lateral delimitations comprise edges, the taller lateral delimitation edge extending substantially to the vertical plane of the shorter lateral delimitation edge.

* * * * *